United States Patent [19]

King

[11] Patent Number: 4,974,484

[45] Date of Patent: Dec. 4, 1990

[54] TAMBOURINE

[76] Inventor: John Q. King, 265 Lincoln Rd., Reading, Pa. 19606

[21] Appl. No.: 508,781

[22] Filed: Mar. 12, 1990

[51] Int. Cl.[5] ..... G10D 13/02

[52] U.S. Cl. ..... 84/418

[58] Field of Search ..... 84/418

[56] References Cited

U.S. PATENT DOCUMENTS 4,330,124 5/1982 Vettorello ..... 84/418

4,858,510 8/1989 Shimoda et al. ..... 84/418

*Primary Examiner*—Lawrence R. Franklin

*Attorney, Agent, or Firm*—Leonard M. Quittner

[57] ABSTRACT

A tambourine which has a body which is annular in shape, has an uninterrupted outer rim and jingles disposed on posts inwardly of its inner rim. The body has a cross-section which is "C" shaped to form a resonating cavity and a solid portion to form a hand hold. The tambourine when grasped by a performer at the hand hold may be rolled on the outer rim upon a surface with back spin such that the tambourine will return to the performer when it decelerates.

6 Claims, 2 Drawing Sheets

TAMBOURINE

BACKGROUND OF THE INVENTION

1. The Field of the Invention.

The field of the invention relates to an improvement in musical percussion instruments and more particularly tambourines.

2. Description of the Prior Art.

The prior art is best demonstrated by USLP #4,858,510 (to Shimoda, et al, Aug. 22 1989); #4,150,162 (to Santiago, Apr. 24, 1979); #636,848 (to Richards, Nov. 14, 1899) and #4,787,635 (to Mynatt; Nov. 29, 1988). Much of the present state of the tambourine art is disclosed in the Shimoda reference. Jingles are mounted on the annular body of the tambourine such that portions of them are exposed to view along the inner and outer perimeter of the body. Resonators are disposed adjacent to the jingles. Santiago discloses a hand hold which is adjacent to the tambourine body such that it cannot be rolled. No resonating member is provided. Richards teaches a smooth outer rim interrupted by a hand hold and a tone arrangement based upon movement around a spiral enclosed within the body. Mynatt discloses a game which employs an annular hoop in which are disposed click producing mechanisms when an untethered ball is kept in play while the hoop arrangement is rolled.

None of the foregoing teaches the combination of the present invention of an uninterrupted rollable outer rim on the tambourine body or jingles disposed along the inner rim of the body in which is integrally formed a resonating cavity.

SUMMARY OF THE INVENTION

Objects of the present invention are to provide a tambourine with improved acoustical properties and has enhanced visual performance values.

Accordingly, to accomplish the foregoing, the present invention is summarized as a generally annular shaped tambourine whose outer rim defines a surface which is uninterrupted in its circularity and whose jingles are inwardly disposed on the inner aspect of the annulus. The annulus has a C-shaped cross-section to created a resonance concavity, the cusps of the "C" being disposed toward the tambourine's center to receive slidably on posts the jingles. The hand hold is formed in a portion of the inner surface to facilitate oscillation of the tambourine and to permit a performer to roll the tambourine on its outer rim with a backspin.

Other objects, advantages and features of the present invention will be apparent to those skilled in the art from the following description taken in conjunction with the accompanying drawings.

DESCRIPTION OF THE DRAWINGS

The present invention may be better understood by reference to the drawings wherein 4 figures are shown on 2 sheets. The numbers shown on the drawings for the various parts of the invention are consistent throughout so that a number indicating a part in one drawing will indicate the same part in another drawing.

DESCRIPTION OF THE PREFERRED EMBODIMENT

Figure 1:
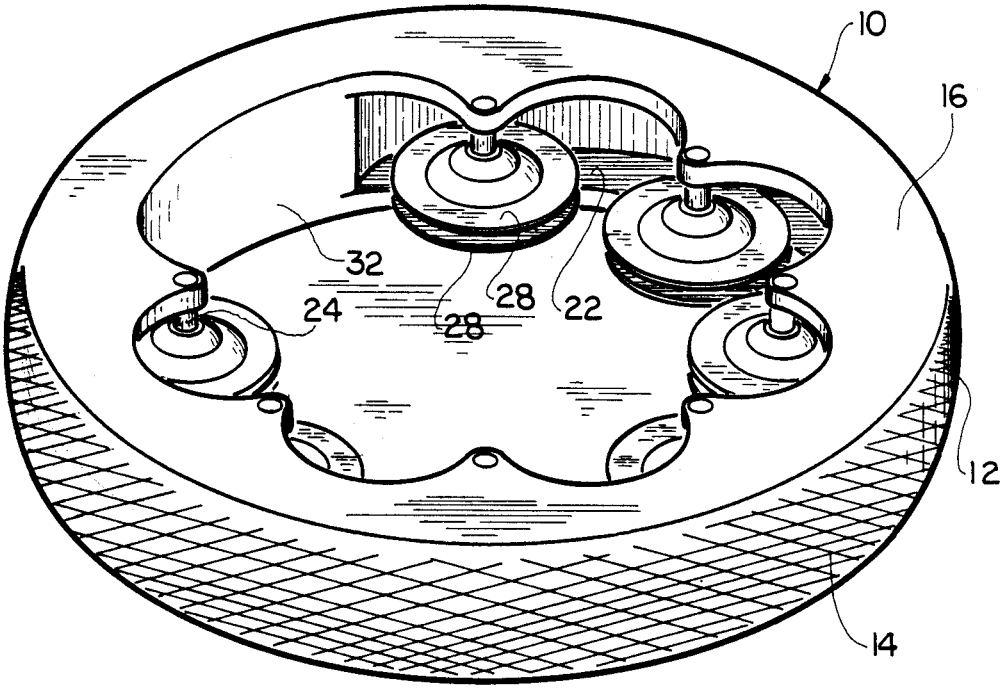
FIG. 1 shows a perspective prone view of the tambourine of the invention.
Figure 2:
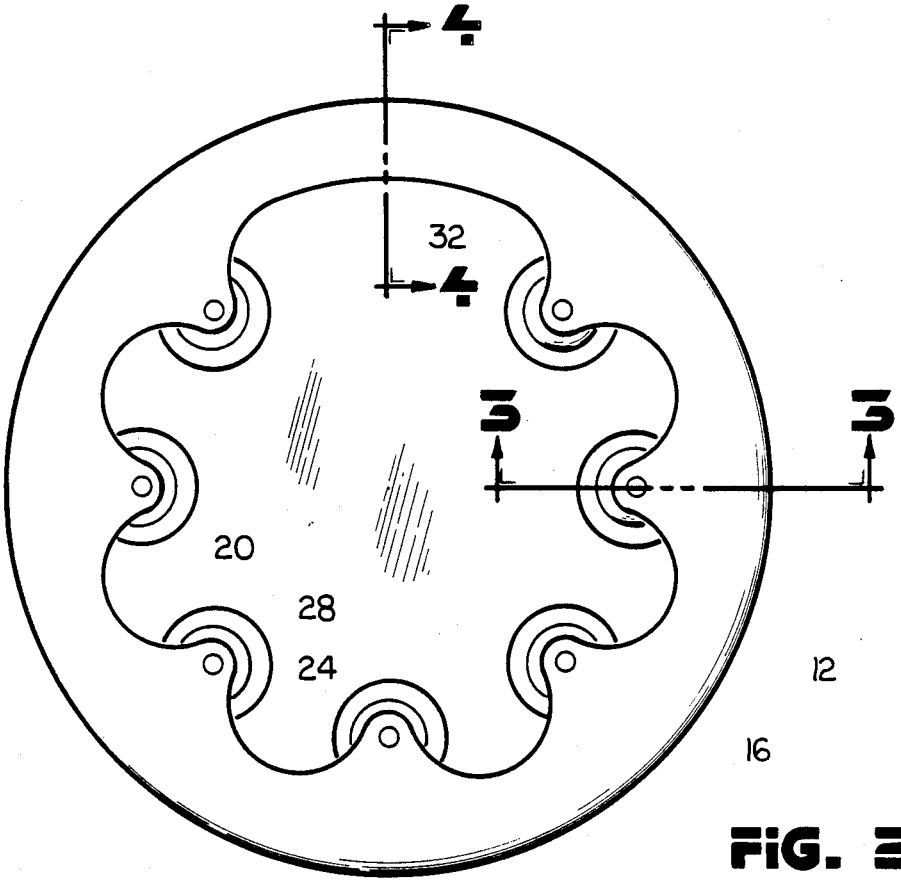
FIG. 2 is a plan view.
Figure 3:
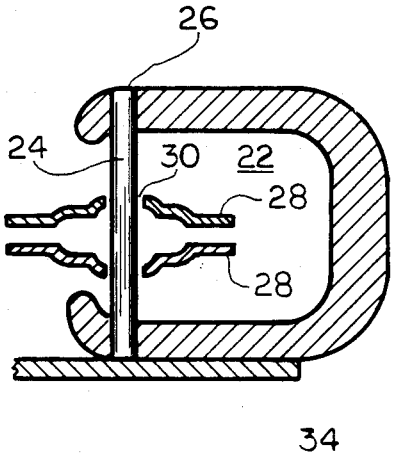
FIG. 3 is a cross-sectional view of the tambourine's resonance cavity 3.
Figure 4:
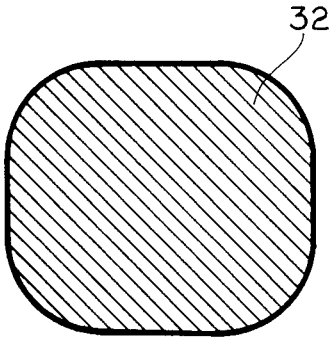
FIG. 4 is a cross-sectional view of the tambourine's hand hold.

The preferred embodiment is described as comprising an improved tambourine 10 which is annular in shape and has an outer rim 12 whose surface 14 is uninterrupted. The outer surface 14 may be roughened (as depicted in FIG. 1.) or smooth. The annulus 16 or tambourine body has a major cross-section 18, (FIG. 3) which is "C" shaped with its opening directed radially inward of the body toward the center of the tambourine and forms a resonance cavity 22. Equally disposed about the inner perimeter 20 are posts 24 of a defined diameter 26 on which are slidably mounted pairs of jingles 28 which may be of defined musical tones and have defined inner diameters 30 relative to the posts. A portion of the body (See FIG. 4) is made solid 32 to facilitate holding by hand.

Optionally the tambourine can be covered across one diameter of the body to form a face 34 made of parchment, skin or the like as one finds on a drum.

In one version of the present invention, the jingles's inner diameters 30 are made substantially larger than the post's diameters 26 to create a deliberately tinny sounding effect.

In operation the tambourine is held at the hand hold 32 and oscillated while intermittently the skin 34 is struck with the free hand or an object. On a stage, the performer may roll the tambourine on its outer rim with back spin imparted to the rolling motion. Upon deceleration the tambourine, because of the back spin, will return to the performer, thereby creating a novel visual and aural effect.

Since many modifications, variations and changes in detail may be made to the presently described embodiment, it is intended that all matters in the foregoing description and accompanying drawings be interpreted as illustrative and not by way of limitation.

What is claimed is:

1. A tambourine comprising:

(a) an annular body with an outer rim and an inner rim, the outer rim's surface being uninterrupted and (b) the inner rim being defined by the cusps of an essentially "C" shaped cross-section taken through the body radially; and (c) disposed between the cusps are posts of a defined diameter spaced apart about the inner rim to receive on each post a first and second jingles each having a defined musical tone and each having an inner defined diameter.

2. A tambourine as in claim 1 wherein a portion of the body is made solid to form a hand hold.

3. A tambourine as in claim 1 wherein the outer rim's surface is made rough to give it traction when the tambourine is rolled upright on a surface.

4. A tambourine as in claim 1 wherein the inner diameter of the jingle is substantially larger than the diameter of the post which receives it such that when the tambourine is oscillated the define tone of the jingle is altered.

5. A tambourine as in claim 1 wherein a planar sheet of a flexible material is stretched to form a face over the surface defined by one major diameter of the body.

6. A tambourine as in claim 1 wherein the "C" shaped cross-section is of sufficient depth to define a chamber for resonating the jingle's tone.

* * * * *